US005165206A

United States Patent [19]

Sword et al.

[11] Patent Number: 5,165,206

[45] Date of Patent: Nov. 24, 1992

[54] PIPE WELD CROWN REMOVAL DEVICE

[75] Inventors: Charles K. Sword, Pleasant Hills; Primo J. Sette, West Newton, both of Pa.

[73] Assignee: The United States of America as represented by the United States Department of Energy, Washington, D.C.

[21] Appl. No.: 765,278

[22] Filed: Sep. 25, 1991

[51] Int. Cl.[5] ..... B24B 19/26

[52] U.S. Cl. ..... 51/241 S; 409/179; 29/33 A

[58] Field of Search ..... 51/241 R, 241 S, 241 B, 51/251; 409/175, 179, 199; 29/33 A

[56] References Cited

U.S. PATENT DOCUMENTS

| | | | |
|---|---|---|---|
| 2,162,187 | 6/1939 | Tharp | 51/241 B |
| 2,455,762 | 12/1948 | Hall . | |
| 2,693,066 | 11/1954 | Berstecher . | |
| 2,696,065 | 12/1954 | Harmes . | |
| 3,070,926 | 1/1963 | Kidd | 51/241 B |
| 3,149,440 | 9/1964 | Maguire . | |
| 3,432,971 | 3/1969 | Conti . | |
| 4,483,106 | 11/1984 | Wachs et al. | 51/241 S |

FOREIGN PATENT DOCUMENTS

| | | | |
|---|---|---|---|
| 0101358 | 8/1980 | Japan | 51/241 S |
| 0512039 | 7/1976 | U.S.S.R. | 51/241 S |

*Primary Examiner*—Roscoe V. Parker

*Attorney, Agent, or Firm*—Judy K. Kosovich; William R. Moser; Richard E. Constant

[57] ABSTRACT

A device is provided for grinding down the crown of a pipe weld joining aligned pipe sections so that the weld is substantially flush with the pipe sections joined by the weld. The device includes a cage assembly comprising a pair of spaced cage rings adapted to be mounted for rotation on the respective pipe sections on opposite sides of the weld, a plurality of grinding wheels, supported by the cage assembly for grinding down the crown of the weld, and a plurality of support shafts, each extending longitudinally along the joined pipe sections, parallel thereto, for individually mounting respective grinding wheels. Each end of the support shafts is mounted for rotation in a bearing assembly housed within a radially directed opening in a corresponding one of the cage rings so as to provide radial movement of the associated shaft, and thus of the associated grinding wheel, towards and away from the weld. A first drive sprocket provides rotation of the cage assembly around the pipe sections while a second drive unit, driven by a common motor, provides rotation of the grinding wheels.

19 Claims, 2 Drawing Sheets

PIPE WELD CROWN REMOVAL DEVICE

FIELD OF THE INVENTION

The present invention relates to a device for removing the outwardly protruding portion or crown of a pipe weld so that the surface of the weld is flush with the surfaces of the pipes being welded together.

BACKGROUND OF THE INVENTION

Among other advantages, removing the crown of a pipe weld so that the weld is flush with the pipes being welded permits ultrasonic inspection of entire weld volume with the ultrasonic beam angle precisely known and without the need to use full vee-path inspection techniques. The chief application of such pipe weld crown removal is in the surface preparation of welds for ultrasonic testing during in-service inspection.

A number of different prior art devices have been developed for cutting and grinding pipes and other cylindrical surfaces. Some examples of such devices are those disclosed in the following patents: U.S. Pat. Nos. 2,693,066 (Berstecher); 3,432,971 (Conti); 2,455,762 (Hall); 2,696,065 (Harnes); and 3,149,440 (Maguire). Briefly considering these patents, the Berstecher patent discloses a portable grinder for a workpiece having cylindrical surfaces such as those of a roll used in paper making. The device encircles the workpiece and includes a plurality of planetary grinding wheels which are carried by ring members and which revolve around the workpiece as well as rotate about the individual axes. The grinding wheels are also movable radially inwardly and outwardly relative to the workpiece by means of a mechanism including a hydraulic piston and a swing link. A system of pulleys and V-belts are used to drive the grinding wheels from a single input drive shaft. The Conti patent discloses a wire grinding machine wherein a pair of grinding wheels are arranged symmetrically with respect to the axis of rotation of, and rotate with, a drum which supports the wheels. A drive assembly mounted in the drum provides for rotation of the wheels about their respective axes. The Hall patent discloses a pipe grinder for grinding ends of pipe roughened by a cutting torch. The grinder is affixed to the open end of a pipe and includes a slidable frame that slides relative to a fixed frame. The Harmes patent discloses a pipe cutter including an abrasive disc which rotates about the pipe to be cut. The Maguire patent discloses a machine for cutting and grinding wherein the associated cutting and grinding tools thereof undergo a planetary and axial movement.

SUMMARY OF THE INVENTION

In accordance with the invention, a device is provided for grinding down or otherwise removing the crown of a pipe weld between joined pipes so that as stated above, the surface of the weld is flush with the joined pipes. The device of the invention is principally applicable to, but not limited to, use in the surface inspection of welds for in-service inspection ultrasonic tests and because the device provides for grinding down of the weld crown flush with the joined pipes, it enables ultrasonic inspection of the entire weld volume.

In accordance with a preferred embodiment of the invention, a device is provided for grinding down the crown of a pipe weld joining first and second pipe sections so that, as stated above, the weld is substantially flush with the pipe sections joined by the weld, the device comprising: a cage assembly comprising first and second spaced cage rings adapted to be mounted on respective weld-joined pipe sections on opposite sides of the weld; a plurality of grinding wheels, supported by said cage assembly for grinding down the crown of the weld; a plurality of support shafts, each extending longitudinally along the joined pipe sections, parallel thereto, for mounting respective grinding wheels; bearing means, disposed at each end of each of the support shafts, for supporting the support shafts for rotation; means for mounting the bearing means within the first and second cage rings so as to provide radial movement of the shafts, and thus of the grinding wheels, towards and away from the outer surface of the joined pipe sections; a first drive means for providing rotation of said cage assembly around the pipe sections; and a second drive means for providing rotation of said grinding wheels.

The first drive means preferably comprises a drive sprocket and an endless drive member such as a timing belt or chain connected between the drive sprocket and one of the cage rings such that rotation of the drive sprocket produces rotation of the cage assembly.

The support shafts preferably include sprockets at one end thereof, and the second drive means preferably comprises a drive sprocket and a belt drive means, connected between the sprockets of the support shafts and that drive sprocket, for converting the rotatory motion of the drive sprocket into rotation of the grinding wheels. The belt drive means advantageously comprises a first drive belt connected between the drive sprocket and at least one sprocket of the sprockets of the shafts for the grinding wheels, and a second drive belt connecting together all of the sprockets of the shafts for the grinding wheels. As explained below, this arrangement ensures that all of the grinding wheels are rotated at the same time. Preferably, the drive sprocket for the cage assembly and that for the support shaft are mounted on a common motor-driven shaft.

The bearing means for the shafts preferably comprise bearings formed in slider members mounted within the cage rings for radial movement towards and away from the outer surface of joined pipe sections. The slider members are preferably mounted on radially extending openings in the cage rings and the bearing mounting means further comprises spring means for biasing the slider members towards the outer surface of joined pipe sections. Advantageously, the spring means comprises a cap screw received in a corresponding opening and a coil spring disposed between the cap screw and the corresponding slider member so as to provide the desired biassing force.

Preferably, at least one of said grinding wheels is axially offset from at least one other grinding wheel so as to ensure grinding down of all the protruding surface of the weld.

The cage rings are preferably of two piece construction so as to enable the rings to be separated and then to be fit and closed around the joined pipe sections.

Preferably, a pair of tracks is mounted on the joined pipe sections on which the cage rings are mounted for rotation. These tracks are also preferably of two piece construction so as to enable separation thereof at at least the end to thereby enable the tracks to be fit around the joined pipe sections.

Other features and advantages of the invention will be set forth in, or apparent from, the following detailed description of preferred embodiments of the invention.

DESCRIPTION OF THE PREFERRED EMBODIMENTS

Figure 1:
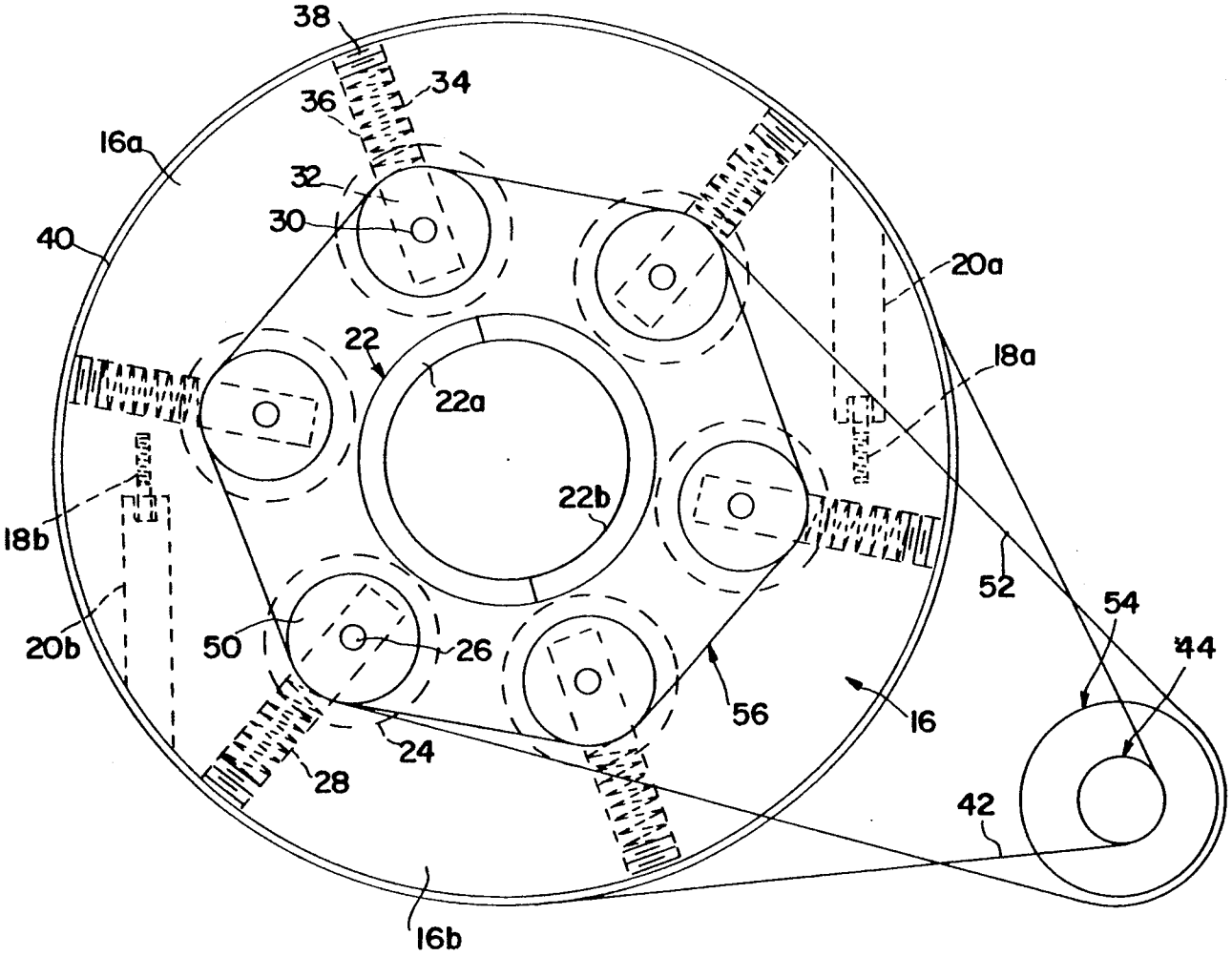
FIG. 1 is a schematic side elevational view of a preferred embodiment of the pipe crown removal device of the invention.
Figure 2:
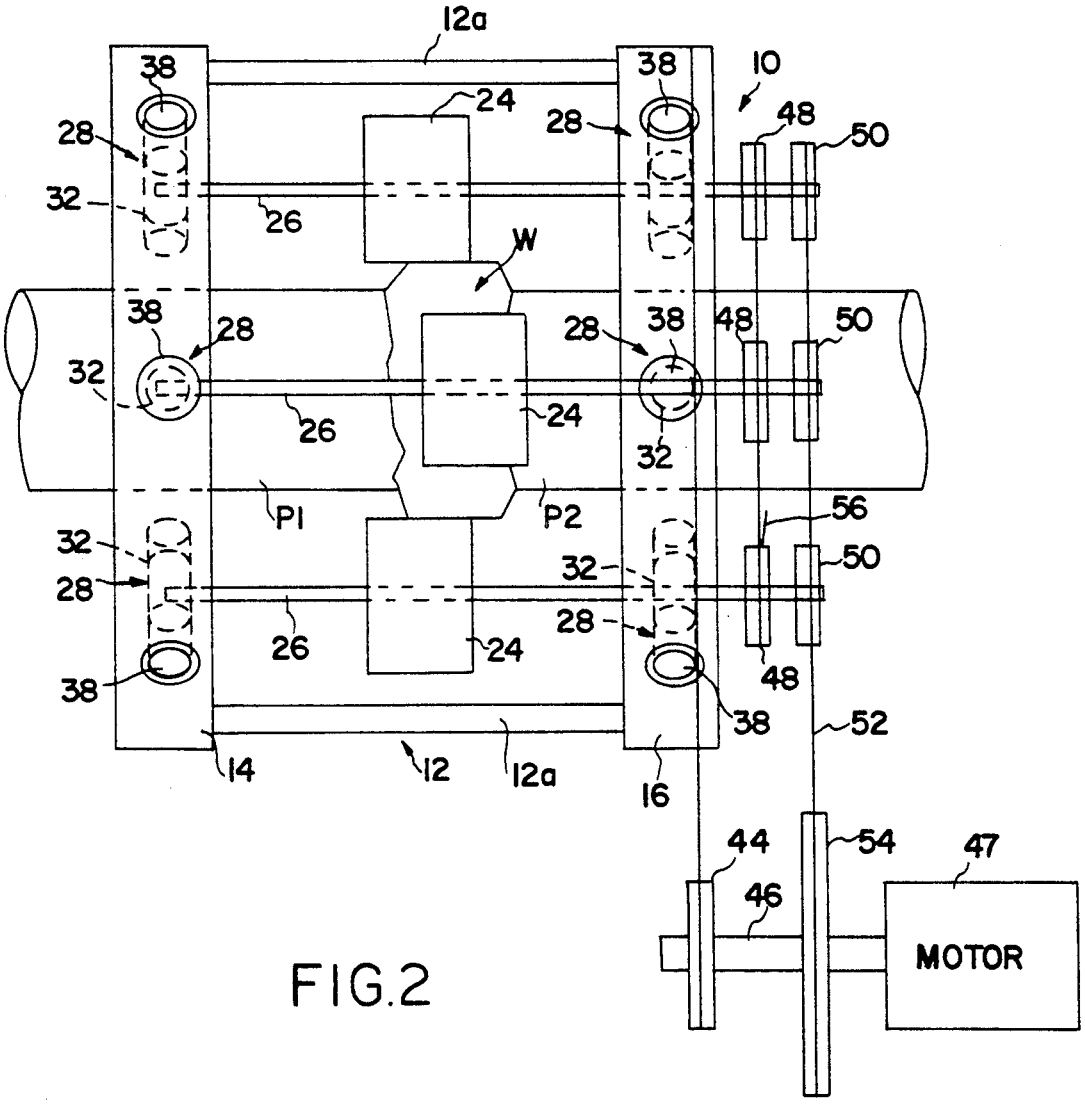
FIG. 2 is a schematic end elevational view of the device of FIG. 1.

Referring to FIGS. 1 and 2, there is shown, in schematic form, a grinding assembly constructed in accordance with a preferred embodiment of the invention. As explained above, the purpose of the invention is to grind down or otherwise remove the crown of a pipe weld so that the weld will be flush with the surfaces of the joined pipes, and referring to FIG. 2, a weld joining aligned pipes P1 and P2 and protruding outwardly so as to form a crown is indicated at W.

The grinding assembly of the invention, which is generally denoted 10, includes a cage assembly 12 comprising first and second annular cages or rings 14 and 16 (see FIG. 2) mounted on pipe sections P1 and pipe section P2, respectively. As can best be seen in FIG. 1, for cage 16, the cage 16 is split, i.e., formed from two halves 16*a* and 16*b*, so that the cage can be fit or mounted around the pipe section P2 without requiring access to an open pipe end. To effect joining of the two halves 16*a* and 16*b* together once they are in place in surrounding relation to pipe section 16*b*, a pair of screws 18*a* and 18*b* are employed. Screws 18*a* and 18*b* are received in respective inwardly directed openings 20*a* and 20*b* which extend generally orthogonally to the mating faces of the cage halves 16*a* and 16*b* and which provide access to the heads of screws 18*a* and 18*b* to enable tightening thereof.

Cage assembly 12 is mounted in a set of annular tracks disposed on respective pipes P1 and P2, one of these tracks, denoted 22, being shown in FIG. 1. Track 22 is also split into two halves or C-sections 22*a* and 22*b* to permit mounting thereof on the outside surface of pipe P2. Track 22 provides an outer bearing surface on which cage 16 rotates. The two halves or C-sections 22*a* and 22*b* are, in accordance with an exemplary embodiment, connected together at each of the mating ends to form a complete ring by a connecting arrangement including a pin (not shown) which is received in a hole (not shown) extending through two matching tongues (not shown) on the two C-sections 22*a* and 22*b*, in a manner similar to a door hinge. A rubber liner (not shown) can be provided, as needed, on the inner or pipe side surface of the track 22 so as to prevent slippage. The outer or cage side surface of track 22, which acts as a bearing surface, or the track 22 itself, is preferably fabricated of any suitable material that minimizes friction between the track 22 and the cage 16.

Cage assembly 12 is used to mount a plurality of grinding and/or cutting wheels 24, i.e., wheels adapted to grind down and/or cut off the crown of weld W. Although six wheels 24 are indicated in FIG. 2, it will be understood that the number of wheels is basically a function of the size (diameter) of the pipe.

As is best seen in FIG. 2, wheels 24 are mounted on shafts 26 which extend longitudinally along, and parallel to, pipe sections P1 and P2 and which are disposed in equiangular spaced relation around the cage assembly 12 and thus around the pipe. Shafts 26 are, in turn, supported at each end thereof by bearing assemblies 28 supported by cages 14 and 16 of cage assembly 12 in such a way that the shafts 26, and thus wheels 24, can move radially in and out. More particularly, each bearing assembly 28 includes a bearing 30 formed in a slider 32 that is slidable within a radially inwardly extending blind hole or opening 34 in the corresponding cage 14 or 16.

As is best seen in FIG. 1, each slider 32 is biassed radially inwardly by a spring 36 and a cap screw 38. The sliders 32 move in and out to maintain contact between the grinding wheels 24 and the work surface, i.e., the surface of weld W, and for this reason, a positive inward biassing force is needed. The spring 36 disposed between the outer end of a slider 32 and the corresponding cap screw 38 provides the necessary inward force. The length and spring constant of each spring 36 are chosen so as to ensure complete travel of the sliders with sufficient inward force. Generally, a travel of no more than ¼ inch is needed. If additional inward force is desired, a shim or shims (not shown) can be placed between the spring 36 and the slider 32 to provide additional preloading.

Cage assembly 12 rotates on tracks 22 around joined pipe sections P1 and P2 during operation of the apparatus of the invention. This rotation results in even grinding of the crown of weld W. To effect this rotation, a sprocket, indicated at 40, is provided on cage 16 around the circumference thereof and a chain or timing belt 42 engages sprocket 40 as well as a small diameter sprocket 44 mounted on a shaft 46 driven by a motor 47. It will be appreciated that rings 14 and 16 of cage assembly 12 are ganged together so as to rotate together, e.g., by connections or links 12*a* between rings 14 and 16.

The individual grinding wheels 24 within cage assembly 12 also rotate, and rotate at a higher rate than cage assembly 12. For this purpose, as shown in FIG. 2, the end of shaft 26 extends through the cage member 16 and has a pair of small diameter sprockets 48 and 50 mounted in spaced relation thereon. A further timing belt or chain 52 extends around sprockets 50 and around a relatively large diameter sprocket 54 mounted on shaft 46 driven by motor 47. A third timing belt or chain 56 extends around and connects together sprockets 48 so that when any of the shafts 26 is caused to rotate by belt 52 being in engagement with the corresponding sprocket 50 mounted on that shaft, the other shafts 26 will also be caused to rotate. It will be appreciated that, as shown in FIG. 1, the timing belt 52 only wraps around and engages four of the sprockets 50 in this embodiment so that the other two sprockets 50, i.e., those at the lower right in FIG. 1, would not rotate at this time if timing belt 56 were not provided.

The purpose of the rotation of cage assembly 12 is to ensure that all of the surface of the weld W is ground by the individual grinding wheels 24. This provides more even grinding than would be the case where the cage assembly 12 was stationary and the wheels 24 turned at the set speeds thereof. Further, the mass of the cage assembly 12 prevents the grinding wheels 24 from being held stationary and the cage assembly 12 being rotated very rapidly to provide the grinding. Hence, it is desirable that the cage assembly 12 rotate slowly while the wheels rotate at a speed sufficient to provide the desired grinding. Thus, the drive sprocket 44 for cage assembly 12 is smaller than the drive sprockets 54 for the grinding wheel shafts 26. The relative diameters of the sprockets 44 and 54 hence govern the relative rotational speeds of the cage assembly 12 and grinding wheels 24, and the relative speeds can be changed by using sprockets of different diameters, or, more generally, by varying the driving sprocket tooth ratios.

As shown in FIG. 2, the grinding wheels 24 are staggered axially to ensure grinding of the entire width of the crown of weld W. A mechanical stop or cut-off switch (not shown) can be included to detect the position of the wheel shafts and prevent over-grinding.

Although the present invention has been described relative to specific exemplary embodiments thereof, it will be understood by those skilled in the art that variations and modifications can be effected in these exemplary embodiments without departing from the scope and spirit of the invention.

What is claimed is:

1. A device for grinding down the crown of a pipe weld joining first and second pipe sections so that the weld is substantially flush with the pipe sections joined by the weld, said device comprising:

a cage assembly comprising first and second spaced cage rings adapted to be mounted on respective pipe sections on opposite sides of a weld joining the pipe sections;

a plurality of grinding wheels, supported by said cage assembly, for grinding down the crown of the weld;

a plurality of support shafts, each extending longitudinally along the joined pipe sections, parallel thereto, for mounting respective grinding wheels;

a bearing means, disposed at each end of each of said support shafts, for supporting said support shafts for rotation;

means for slidably mounting said bearing means within said first and second rings so as to provide radial movement of said shafts, and thus of said grinding wheels, towards and away from the outer surface of the pipe sections;

a first drive means for providing rotation of said cage assembly around the pipe sections; and a second drive means for providing rotation of said grinding wheels.

2. A grinding device as claimed in claim 1 wherein said first drive means comprises a drive sprocket and an endless drive member connected between said drive sprocket and one of said cage rings such that rotation of said drive sprocket produces rotation of said cage assembly.

3. A grinding device as claimed in claim 1 wherein said shafts include sprockets at one end thereof and said second drive means comprises a drive sprocket and a belt drive means, connected between the sprockets of the shafts and said drive sprocket, for converting the rotatory motion of said drive sprocket into rotation of said grinding wheels.

4. A grinding device as claimed in claim 3 wherein said belt drive means comprises a first drive belt connected between said drive sprocket and at least one sprocket of the sprockets of the shafts for the grinding wheels, and a second drive belt connecting together all of the sprockets of the shafts for the grinding wheels.

5. A grinding device as claimed in claim 1 wherein said bearing means comprises bearings formed in slider members mounted within said cage rings for radial movement towards and away from the outer surface of the joined pipe sections.

6. A grinding device as claimed in claim 5 wherein said slider members are mounted in radially extending openings in said cage rings and said mounting means further comprises spring means for biasing said slider members inwardly towards the outer surface of the joined pipe sections.

7. A grinding device as claimed in claim 6 wherein said spring means comprises a cap screw received in a said opening and a coil spring disposed between said cap screw and the corresponding slider member.

8. A grinding device as claimed in claim 1 wherein at least one of said grinding wheels is axially offset with respect to at least one other grinding wheel.

9. A grinding device as claimed in claim 1 wherein said cage rings are of two piece construction so as to enable the rings to be fit around the joined pipe sections.

10. A grinding device as claimed in claim 1 further comprising a pair of tracks mounted on said joined pipe sections on which said cage rings are mounted for rotation.

11. A grinding device as claimed in claim 10 wherein said tracks are of two piece construction so as to enable the tracks to be fit around the joined pipe sections.

12. A device for grinding down the crown of a pipe weld joining first and second pipe sections so that the weld is substantially flush with the pipe sections joined by the weld, said device comprising:

a cage assembly comprising first and second spaced cage rings adapted to be mounted on respective weld-joined pipe sections on opposite sides of a weld joining the pipe sections;

track means adapted to be mounted on the respective pipe sections on opposite sides of the weld, for mounting the cage assembly on the joined sections for rotation around the outer surface of the joined pipe sections;

a plurality of grinding wheels, supported by said cage assembly, for grinding down the crown of the weld;

a plurality of support shafts, each extending longitudinally along the joined pipe sections, parallel thereto, for individually mounting said grinding wheels;

bearing means, disposed at each end of each of said support shafts, for supporting said support shafts for rotation;

means for mounting said bearing means within, in radial extending openings in said first and second cage rings so as to provide radial movement of said shafts, and thus of said grinding wheels, towards and away from the outer surface of the pipe sections;

a first drive means for providing rotation of said cage assembly around the pipe sections; and a second drive means for providing rotation of said grinding wheels.

13. A grinding device as claimed in claim 12 wherein said first drive means comprises a drive sprocket and an endless drive member connected between said drive sprocket and one of said cage rings such that rotation of said drive sprocket produces rotation of said cage assembly.

14. A grinding device as claimed in claim 12 wherein said shafts include sprockets at one end thereof and said second drive means comprises a drive sprocket and a belt drive means, connected between the sprockets of the shafts and said drive sprocket, for converting the rotatory motion of said drive sprocket into rotation of said grinding wheels.

15. A grinding device as claimed in claim 14 wherein said belt drive means comprises a first drive belt connected between said drive sprocket and at least one sprocket of the sprockets of the shafts for the grinding wheels, and a second drive belt connecting together all of the sprockets of the shafts for the grinding wheels.

16. A grinding device as claimed in claim 12 wherein said bearing means comprises bearings formed in slider members mounted within said openings in said cage rings for radial movement towards and away from the outer surface of the joined pipe sections.

17. A grinding device as claimed in claim 16 wherein said mounting means comprises spring means for biasing said slider members inwardly towards the outer surface of the joined pipe sections.

18. A grinding device as claimed in claim 17 wherein said spring means comprises a cap screw received in a said opening and a coil spring disposed between said cap screw and the corresponding slider member.

19. A grinding device as claimed in claim 12 wherein at least one of said grinding wheels is axially offset with respect to at least one other grinding wheel.

* * * * *